US005620839A

United States Patent [19]

Kawamoto et al.

[11] Patent Number: 5,620,839

[45] Date of Patent: Apr. 15, 1997

[54] SILVER HALIDE PHOTOGRAPHIC MATERIAL

[75] Inventors: Fumio Kawamoto; Shigeru Ohno, both of Kanagawa, Japan

[73] Assignee: Fuji Photo Film Co., Ltd., Kanagawa, Japan

[21] Appl. No.: 357,749

[22] Filed: Dec. 16, 1994

[30] Foreign Application Priority Data

Dec. 16, 1993 [JP] Japan ..... 5-316676

[51] Int. Cl.[6] ..... G03C 1/76

[52] U.S. Cl. ..... 430/523; 430/517; 430/521; 430/531; 430/533

[58] Field of Search ..... 430/517, 521, 430/523, 531, 533

[56] References Cited

U.S. PATENT DOCUMENTS

| | | | |
|---|---|---|---|
| 3,340,062 | 9/1967 | Hunter et al. | 430/510 |
| 3,846,369 | 11/1974 | Whyte | 524/718 |
| 3,918,976 | 11/1975 | Arai et al. | 96/84 R |
| 3,948,664 | 4/1976 | Okuyama et al. | 96/84 R |
| 4,191,679 | 3/1980 | Okita et al. | 8/512 |
| 4,255,516 | 3/1981 | Katoh et al. | 430/533 |
| 4,628,025 | 12/1986 | Komaita et al. | 430/533 |
| 5,061,612 | 10/1991 | Kiyohara et al. | 430/533 |
| 5,326,689 | 7/1994 | Murayama | 430/530 |
| 5,496,687 | 3/1996 | Kawamoto | 430/496 |

FOREIGN PATENT DOCUMENTS

| | | |
|---|---|---|
| 0387015 | 9/1990 | European Pat. Off. . |
| 0583787 | 2/1994 | European Pat. Off. . |
| 0581120 | 2/1994 | European Pat. Off. . |
| 0606070 | 7/1994 | European Pat. Off. . |
| 1314085 | 4/1973 | United Kingdom . |
| 1502315 | 4/1974 | United Kingdom . |

*Primary Examiner*—Geraldine Letscher
*Attorney, Agent, or Firm*—Sughrue, Mion, Zinn, Macpeak & Seas

[57] ABSTRACT

A silver halide photographic material is disclosed, which comprises a support having thereon at least one silver halide emulsion layer, wherein the support is polyester having a glass transition temperature of from 90° C. to 200° C. and contains a specific dye and/or an inorganic pigment in a slight amount.

6 Claims, No Drawings

SILVER HALIDE PHOTOGRAPHIC MATERIAL

FIELD OF THE INVENTION

The present invention relates to a silver halide photographic material, and especially to a silver halide photographic material having excellent anti-curling properties and light-piping preventing properties.

BACKGROUND OF THE INVENTION

Since a polyester film has excellent producibility, mechanical strength and dimensional stability, it has heretofore been considered to be substitutable for TAC. However, when the polyester film is used as a support of a photographic material of the most popular roll film, it strongly curls and the curl of the film strongly remains even after development. As a result, the handling of the curled film is difficult and troublesome after development. Therefore, despite of the above-mentioned excellent properties, the use of the polyester film in the field of photographic materials has heretofore been limited.

For reducing the curling property of a polyester film, JP-A-51-16358 (the term "JP-A" as used herein means an "unexamined published Japanese patent application") discloses a method in which a polyester film is heat-treated at a temperature lower than its glass transition temperature by 5° C. to 30° C.

Some kinds of a polyester film have a higher refractive index than that of TAC or PET, which causes light fogging due to so-called light piping. This problem has been required to be solved.

On the other hand, the use of photographic materials is widely diversified in recent years, and the technology for rapid feeding in a camera or the like during picture-taking, elevation of image magnification, and reduction of the size of picture-taking devices has advanced noticeably. With this advanced technology, the support of photographic materials must have high strength and high dimensional stability and be as thin as possible.

In addition, with the great reduction of the size of picture-taking devices, the demand for reducing the size of film-housing cartridges has also become great. TAC supports cannot satisfy the demand due to lack of the mechanical strength.

Reduction of the size of a cartridge involves two problems.

The first problem is that the reduction of the thickness of the film to be in the cartridge is accompanied by lowering of the mechanical strength of the film itself.

The second problem is that the film in a small-sized cartridge with a small-sized spool is strongly curled during storage of the film. For instance, if the exposed film taken out of such a small-sized cartridge is developed in a mini-laboratory automatic developing machine, the film would be curled up during handling, since only one edge of the film is fixed to the leader but the other one is not, so that feeding of a processing solution to the curled up area would be delayed to cause so called "uneven development". In addition, the curled-up film would be crushed in the machine and the film being processed would then be "bent or broken".

SUMMARY OF THE INVENTION

An object of the present invention is to provide a silver halide photographic material having excellent mechanical properties, which is hard to curl when the cartridge size is reduced an which is free from light fogging due to light piping.

This and other objects of the present invention have been attained by a silver halide photographic material comprising a support having thereon at least one silver halide emulsion layer, wherein the support is polyester having a glass transition temperature of from 90° C. to 200° C. and contains at least one of a dye and an inorganic pigment in a slight amount.

In a preferred embodiment, the dye is a compound represented by formula (I) or (II):

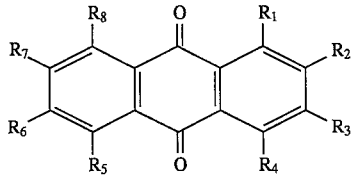

(I)

wherein $R_1$, $R_2$, $R_3$, $R_4$, $R_5$, $R_6$, $R_7$ and $R_8$ are the same or different and each represents a hydrogen atom, a hydroxyl group, an aliphatic group, an aromatic group, a heterocylic group, a halogen atom, a cyano group, a nitro group, $—COR_9$, $—COOR_9$, $—NR_9R_{10}$, $—NR_{10}COR_{11}$, $—NR_{10}SO_2R_{11}$, $—CONR_9R_{10}$, $—SO_2NR_9R_{10}$, $—OR_{11}$, $—SO_2R_{11}$, $—OCOR_{11}$, $—NR_9CONR_{10}R_{11}$, $—CONHSO_2R_{11}$ or $—SO_2NHCOR_{11}$, in which $R_9$ and $R_{10}$ each represents a hydrogen atom, an aliphatic group, an aromatic group or a heterocyclic group, $R_{11}$ represents an aliphatic group, an aromatic group or a heterocyclic group, and $R_9$ and $R_{10}$ may be combined with each other to form a 5- or 6-membered ring; and $R_1$ and $R_2$, or $R_2$ and $R_3$ may be combined with each other to form a ring;

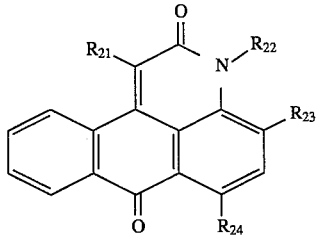

(II)

wherein $R_{21}$, $R_{23}$ and $R_{24}$ are the same or different and each represents a hydrogen atom, a hydroxyl group, a nitro group, a cyano group, an aliphatic group, an aromatic group, $—COR_{29}—COOR_{29}—NR_{29}R_{30}$, $—NR_{30}COR_{31}$ or $—NR_{30}SO_2R_{31}$, in which $R_{29}$ and $R_{30}$ each has the same meanings as those defined for $R_9$ and $R_{10}$ in formula (I), and $R_{31}$ has the same meanings as those defined for $R_{11}$ in formula (I); $R_{22}$ represents an aliphatic group or an aromatic group; and at least one of $R_{21}$, $R_{22}$, $R_{23}$ and $R_{24}$ is a group other than a hydrogen atom.

DETAILED DESCRIPTION OF THE INVENTION

Examples of the aliphatic group represented by $R_1$ to $R_{11}$ include an alkyl group containing from 1 to 20 carbon atoms (e.g., methyl, ethyl, n-butyl, isopropyl, 2-ethylhexyl, n-decyl, n-octadecyl), a cycloalkyl group containing from 3 to 20 carbon atoms (e.g., cyclopentyl, cyclohexyl ) or an allyl group containing from 3 to 20 carbon atoms, which may contain a substituent (s) including, for example, a halogen atom (e.g., F, Cl, Br, I), a hydroxyl group, a cyano group, a nitro group, a carboxylic acid, an aryl group containing from 6 to 10 carbon atoms (e.g., phenyl, naphthyl ), an amino group containing from 0 to 20 carbon atoms (e.g., $—NH_2$, $—NHCH_3$, $—N(C_2H_5)_2$, $—N(C_4H_9)_2$, $—N(C_8H_{17})_2$, anilino, 4-methoxyanilino), an amido group containing from 1 to 20 carbon atoms (e.g., acetylamino, hexanoylamino, benzoylamino, octadecanoylamino), a carbamoyl group containing from 1 to 20 carbon atoms (e.g., unsubstituted carbamoyl, methylcarbamoyl, ethylcarbamoyl, octylcarbamoyl, hexadecylcarbamoyl), an ester group containing from 2 to 20 carbon atoms (e.g., methoxycarbonyl, ethoxycarbonyl, phenoxycarbonyl, n-butoxycarbonyl, dodecyloxycarbonyl), an alkoxy or aryloxy group containing from 1 to 20 carbon atoms (e.g., methoxy, ethoxy, butoxy, iso-propoxy, benzyloxy, phenoxy, octadecyloxy), a sulfonamido group containing from 1 to 20 carbon atoms (e.g., methanesulfonamido, ethanesulfonamido, butanesulfonamido, benzenesulfonamido, octanesulfonamido), a sulfamoyl group containing from 0 to 20 atoms (e.g., unsubstituted sulfamoyl, methylsubfamoyl, butylsulfamoyl, decylsulfamoyl), and a 5- or 6-membered heterocyclic ring (e.g., pyridyl, pyrazolyl, morpholino, piperidino, pyrrolyl, benzoxazolyl).

Examples of the aromatic group represented by $R_1$ to $R_{11}$ include an aryl group containing from 6 to 10 carbon atoms (e.g., phenyl, naphthyl), which may contain a substituent(s), in addition to the substituents enumerated as the substituents for the aliphatic group, including, for example, an alkyl group containing from 1 to 20 carbon atoms (e.g., methyl, ethyl, butyl, t-butyl, octyl).

Examples of the heterocyclic group represented by $R_1$ to $R_{11}$ includes a 5- or 6-membered heterocyclic ring (e.g., pyridine, piperidine, morpholine, pyrrolidine, pyrazole, pyrazolidine, pyrazoline, pyrazolone, benzoxazole ), which may contain a substituent (s) the above aromatic group represented by $R_1$ to $R_{11}$ may contain.

Examples of the 5- or 6-membered ring formed by combining with $R_9$ and $R_{10}$ include a morpholine ring, a piperidine ring, and a pyrrolidine ring. The ring formed by combining with $R_1$ and $R_2$ or $R_2$ and $R_3$ is preferably a 5- or 6-membered ring (e.g., benzene ring, phthalimide ring) .

The aliphatic group represented by $R_{21}$ to $R_{24}$ has the same meanings as those defined for $R_1$ to $R_{11}$ in formula (I). The aromatic group represented by $R_{21}$ to $R_{24}$ has the same meanings as those defined for $R_1$ to $R_{11}$.

Examples of the compounds represented by formula (I) or (II) are set froth below, but the present invention should not be construed as being limited thereto.

(I-1)

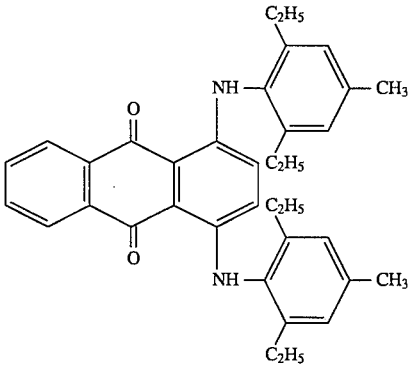

(I-2)

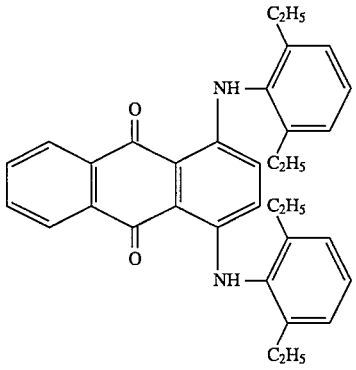

(I-3)

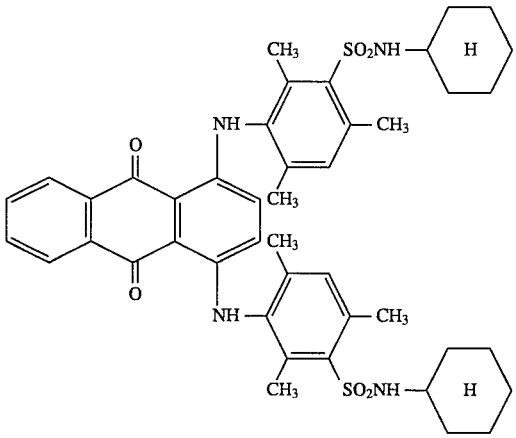

(I-4)

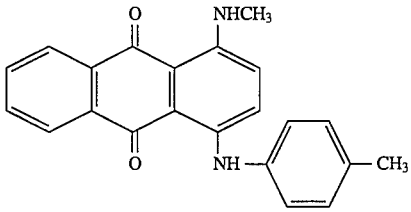

(I-5)

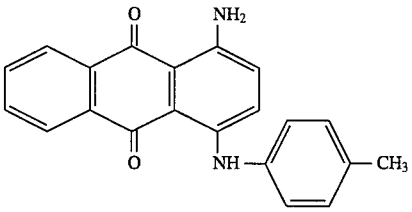

-continued
(I-6)
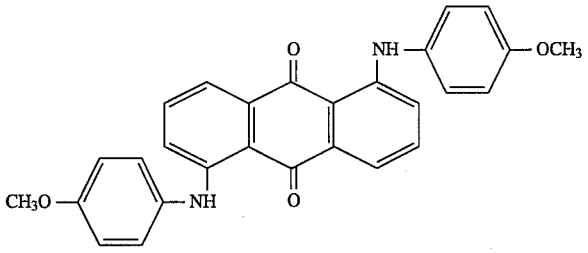
(I-7)
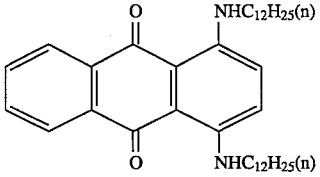
(I-8)
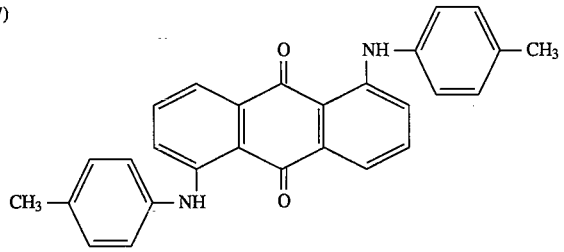
(I-9)
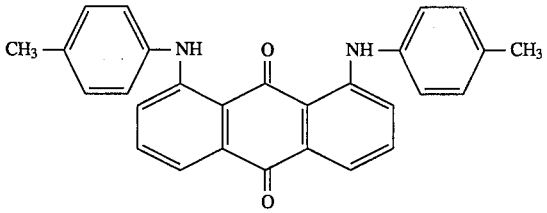
(I-10)
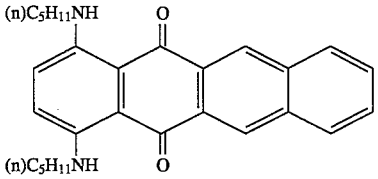
(I-11)
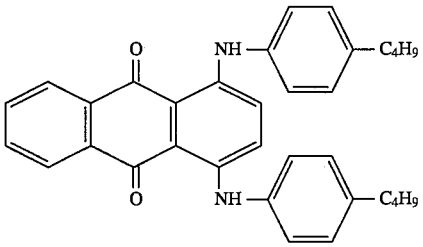
(I-12)
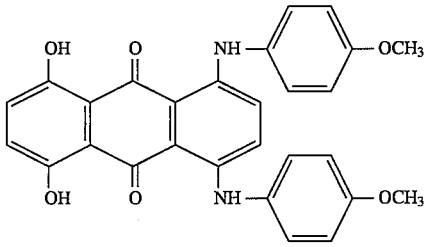
(I-13)
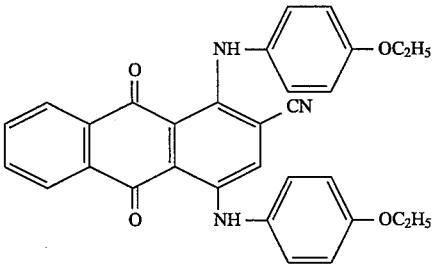
(I-14)
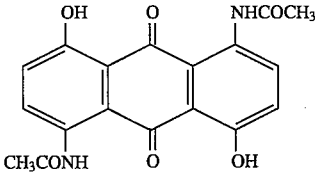
(I-15)
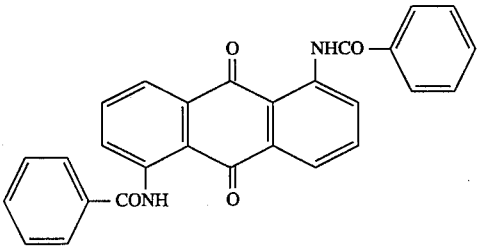
(I-16)
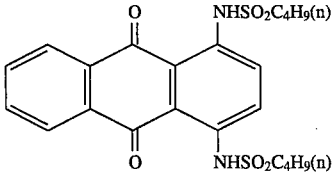

-continued
(I-17)
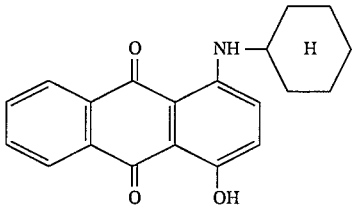
(I-18)
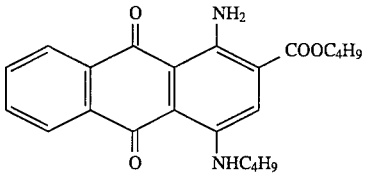
(I-19)
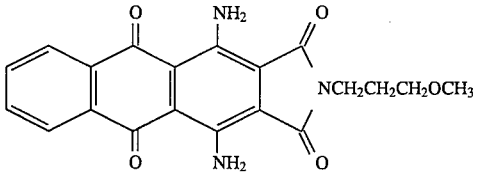
(I-20)
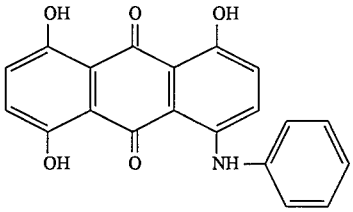
(I-21)
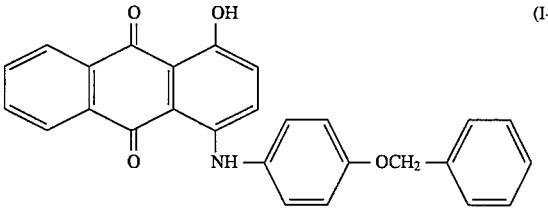
(I-22)
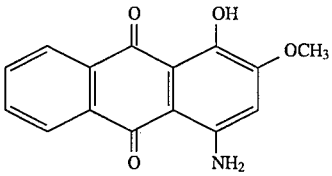
(I-23)
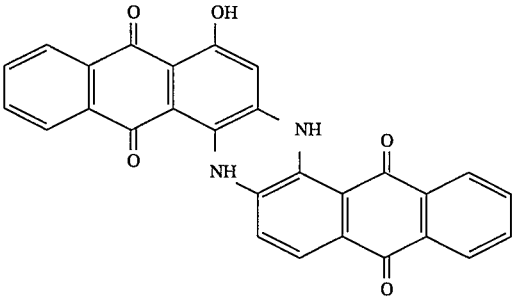
(I-24)
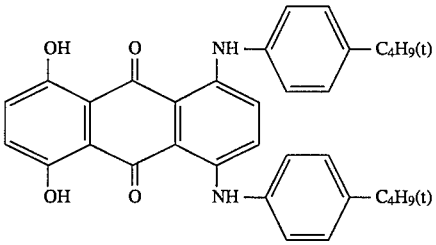
(I-25)
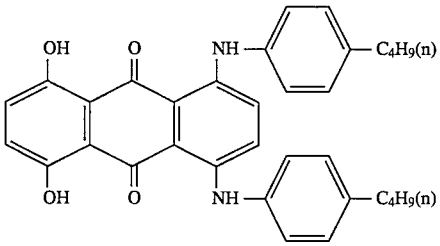
(I-26)
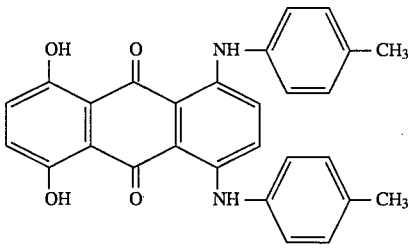
(I-27)
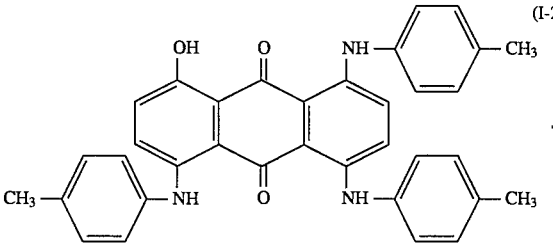
(I-28)
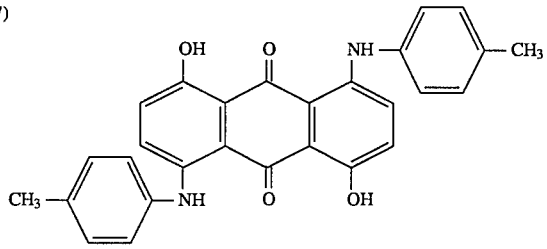

-continued (II-1)

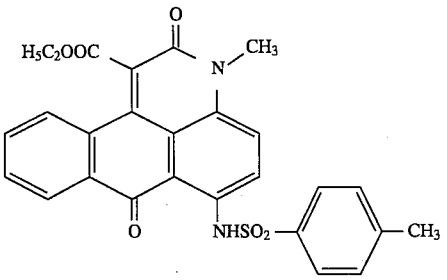

(II-2)

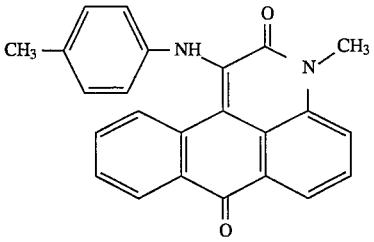

(II-3)

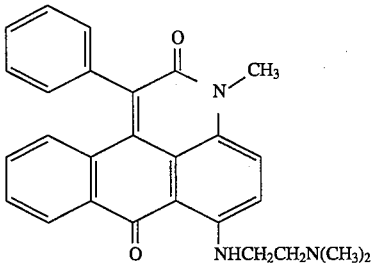

(II-4)

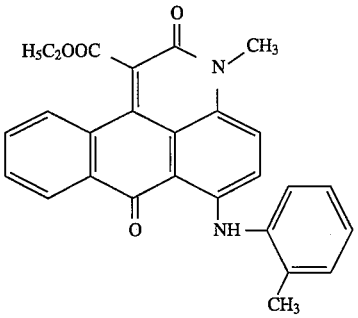

(II-5)

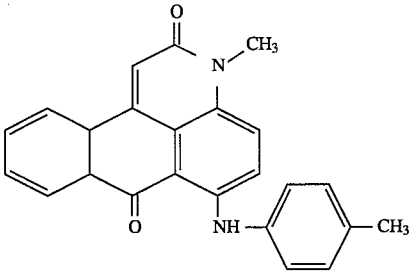

The compounds represented by formula (I) or (II) can be synthesized by the method as disclosed, for example, in JP-B-45-15187, JP-B-51-25335, JP-B-51-33724, JP-B-55-19943 (the term "JP-B" as used herein means an "examined Japanese patent publication"), M. Matsuoka, M. Kishimoto, T. Kitao, *J. Soc. Dyers and Coloruists*, vol. 94, page 435 (1978), Y. Hosoda, *Senryo Kaqaku* ("Dye Chemistry"), pages 673 to 741, Gihodo K. K. (1957).

The dye represented by formula (I) or (II) and/or pigment is preferably used in an amount of from 0.001 to 1 g/m$^2$, more preferably from 0.005 to 0.5 g/m$^2$.

The dye of the present invention may be used alone or in combination.

The dye of the present invention is used in such a manner that the final increased amount of the transmission density is from 0.005 to 0.5, preferably from 0.01 to 0.3, and more preferably from 0.01 to 0.1.

The pigment to be used in the present invention is selected from carbon black and at least one compound of an oxide, a sulfide, a sulfate, a sulfite, a carbonate, a hydroxide, a halide or a nitrate of an alkaline metal, an alkaline earth metal, Si, Al, Ti or Fe. Among these, carbon black and titanium dioxide are preferred.

The pigment to be used in the present invention is added in such a manner that the final increased amount of the transmission density is from 0.005 to 0.5, preferably from 0.01 to 0.3, and more preferably from 0.01 to 0.1.

The pigment and dye may be used in combination, but the total addition amount thereof should be falling within the above-specified ranges.

In the present invention, light-piping prevention can be achieved by incorporating the dye and/or the pigment into a support.

The glass transition temperature of the polyester to be used as a support in the present invention is preferably from 90° C. to 200° C.

Furthermore, the thickness of the support used in the present invention is preferably from 50 μm to 300 μm. If it is smaller than 50 μm, it is intolerable for the shrinkage stress of a light-sensitive layer which occurs on drying. If it is higher than 300 μm, it loses the effect of reducing the thickness for reducing the size.

Furthermore, it is necessary that the heat treatment of a support to be used in the present invention is conducted at from 50° C. to its glass transition temperature for from 0.1 hour to 1500 hours after forming a film and before coating a light-sensitive layer.

Polyesters having a glass transition temperature of from 90° C. to 200° C. for use in the present invention are composed of a diol and a dicarboxylic acid.

Usable dibasic acids of polyester components include terephthalic acid, isophthalic acid, phthalic acid, phthalic anhydride, succinic acid, glutaric acid, adipic acid, sebacic acid, succinic anhydride, maleic acid, fumaric acid, maleic anhydride, itaconic acid, citraconic anhydride, tetrahydrophthalic anhydride, diphenylene-p,p'-dicarboxylic acid, tetrachlorophthalic anhydride, 3,6-endomethylene-tetrahydrophthalic anhydride, 1,4-cyclohexanedicarboxylic acid, and the following dibasic acids:

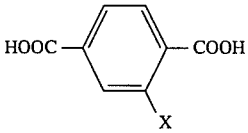
(X: halogen atom),
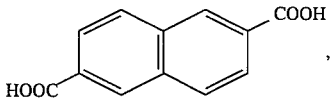
,
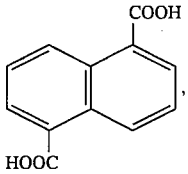
,
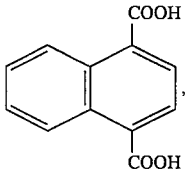
,
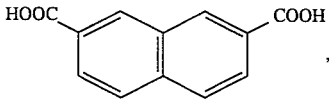
,
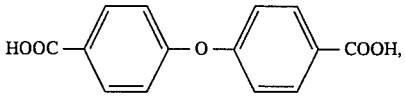
,
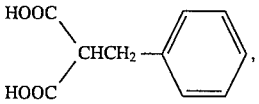
,
;
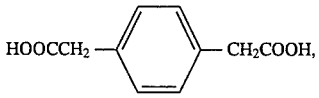
,
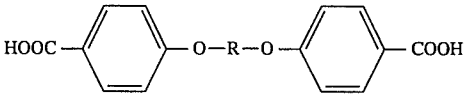
(R: $C_1$–$C_5$ alkylene),
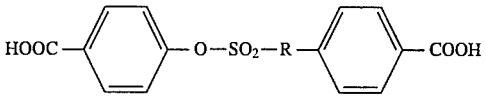
(R: $C_1$–$C_5$ alkylene),
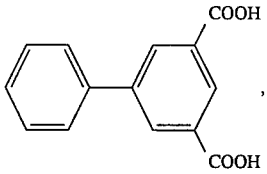
,
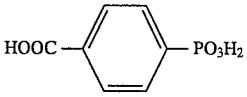
Usable diols include ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,3-cyclohexanediol, 1,1-cyclohexanedimethanol, catechol, resorcinol, hydroquinone, 1,4-benzene-dimethanol and the following diols:
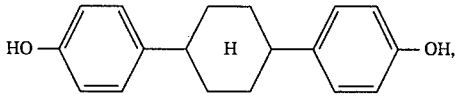
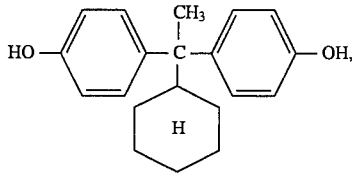
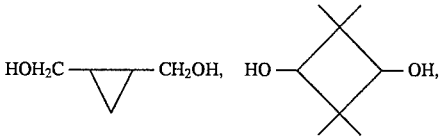
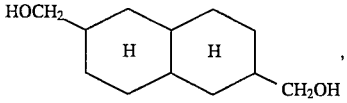
,
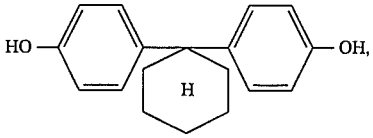
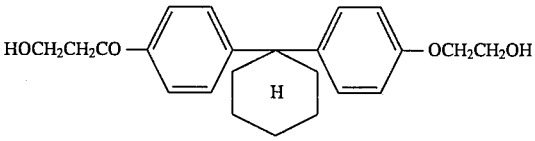
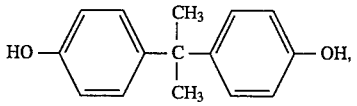
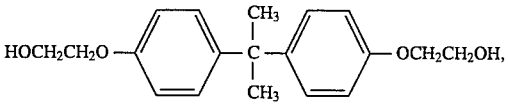
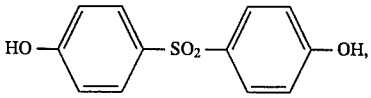
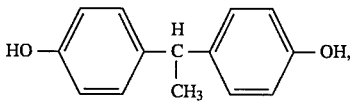
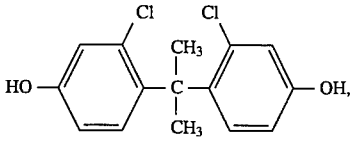

-continued

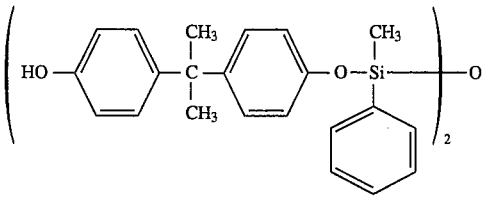

If desired, copolyesters containing additional comonomers of mono-functional or tri- or more poly-functional hydroxyl group-containing compounds or acid-containing compounds may also be used in the present invention.

Also suitable in the present invention are copolyesters containing additional comonomers of compounds having both hydroxyl group(s) and carboxyl (or its ester) group(s) in the molecule.

Examples of such comonomers include the following compounds:

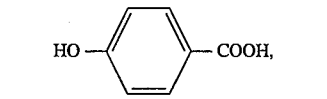

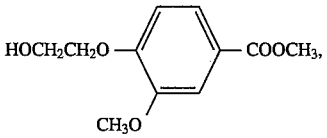

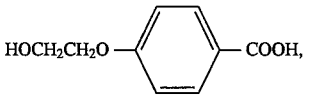

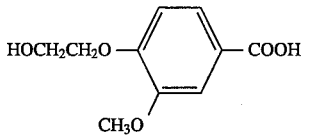

Preferred polyesters include homopolymers such as polyethylene, 2,6-dinaphthalate (PEN), polyacrylate (PAr), and polycyclohexanedimethanolterepthalate (PCT) and those obtained by copolymerizing a dicarboxylic acid such as 2,6-naphthalenedicarboxylic acid (NDCA), terephthalic acid (TPA), isophthalic acid (IPA), orthophthalic acid (OPA), cyclohexanedicarboxylic acid (CHDC) or paraphenylenedicarboxylic acid (PPDC) and a diol such as ethylene glycol (EG), cyclohexane dimethanol (CHDM), neopentyl glycol (NPG), bisphenol A (BPA) or biphenol (BP) and optionally also a hydroxycarboxylic acid such as parahydroxybenzoic acid (PHBA) or 6-hydroxy-2-naphthalenecarboxylic acid (HNCA). Of them, preferred are copolymers of naphthalene-dicarboxylic acid, terephthalic acid and ethylene glycol (in which the molar ratio of naphthalenedicarboxylic acid to terephthalic acid is preferably from 0.3/0.7 to 1.0/0, more preferably from 0.5/0.5 to 0.8/0.2); copolymers of terephthalic acid, ethylene glycol and bisphenol A (in which the molar ratio of ethylene glycol to bisphenol A is preferably from 0.6/0.4 to 0/1.0, more preferably 0.5/0.5 to 0/0.9); copolymers of isophthalic acid, paraphenylenedicarboxylic acid, terephthalic acid and ethylene glycol (in which the molar ratio of isophthalic acid to terephthalic acid and that of paraphenylenedicarboxylic acid to the same are preferably from 0.1/1 to 10.0/1 and from 0.1/1 to 20/1, respectively, more preferably from 2/1 to 5.0/1 and from 0.2/1 to 10.0/1, respectively); copolymers of naphthalenedicarboxylic acid, neopentyl glycol and ethylene glycol (in which the molar ratio of neopentyl glycol to ethylene glycol is preferably from 1/0 to 0.7/0.3, more preferably from 0.9/0.1 to 0.6/0.4); copolymers of terephthalic acid, ethylene glycol and biphenol (in which the molar ratio of ethylene glycol to biphenol is preferably from 0/1.0 to 0.8/0.2, more preferably from 0.1/0.9 to 0.7/0.3); and copolymers of parahydroxybenzoic acid, ethylene glycol and terephthalic acid (in which the molar ratio of parahydroxybenzoic acid to ethylene glycol is preferably from 1/0 to 0.1/0.9, more preferably from 0.9/0.1 to 0.2/0.8). Also suitable are polymer blends of, for example, PEN and PET (in which the ratio of the two is preferably from 0.3/0.7 to 1.0/0, more preferably from 0.5/0.5 to 0.8/0.2); and PET and PAr (in which the ratio of the two is preferably from 0.6/0.4 to 0/1.0, more preferably from 0.5/0.5 to 0.1/0.9).

The polyester film mainly comprising naphthalene dicarboxylic acid and ethylene glycol is more preferred.

The most preferred polyester film is polyethylene-2,6-naphthalene dicarboxylate.

These homopolymers and copolymers may be produced by conventional methods of producing conventional polyesters.

Regarding the polyester producing methods, for example, the descriptions in *Studies of Polymer Experiments*, Vol. 5 "Polycondensation and Addition Polymerization" (published by Kyoritsu Publishing Co., 1980), pp. 103–136; and *Synthetic Polymers V* (published by Asakura Shoten K. K., 1971), pp. 187–286, may be referred to.

The polyesters for use in the present invention preferably have a mean molecular weight of approximately from 5,000 to 500,000.

Polymer blends of such polymers may easily be formed in accordance with the methods described i n JP-A49-5482, JP-A-64-4325, JP-A-3-192718, and *Research Disclosure* 283739–41, 284779–82 and 294807–14.

Preferred examples of polyesters for use in the present invention are mentioned below:

Exemplary Polyester Compounds

Homopolymers:

| | | |
|---|---|---|
| PEN: | [2,6-naphthalene-dicarboxylic acid (NDCA)/ethylene glycol (EG) (100/100)] | Tg = 119° C. |
| PCT: | [terephthalic acid (TPA)/cyclohexane dimethanol (CHDM) (100/100)] | Tg = 93° C. |
| PAr: | [TPA/bisphenol A (BPA) (100/100)] | Tg = 192° C. |
| | Copolymers (the parenthesized ratio is by mol): | |
| PBC-1: | 2,6-NDCA/TPA/EG (50/50/100) | Tg = 92° C. |
| PBC-2: | 2,6-NDCA/TPA/EG (75/25/100) | Tg = 102° C. |
| PBC-3: | 2,6-NDCA/TPA/EG/BPA (50/50/75/25) | Tg = 112° C. |
| PBC-4: | TPA/EG/BPA (100/50/50) | Tg = 105° C. |
| PBC-5: | TPA/EG/BPA (100/25/75) | Tg = 135° C. |
| PBC-6: | TPA/EG/CHDM/BPA (100/25/25/50) | Tg = 115° C. |
| PBC-7: | IPA/PPDC/TPA/EG (20/50/30/100) | Tg = 95° C. |
| PBC-8: | NDCA/NPG/EG (100/70/30) | Tg = 105° C. |
| PBC-9: | TPA/EG/BP (100/20/80) | Tg = 115° C. |
| PBC-10: | PHBA/EG/TPA (200/100/100) | Tg = 125° C. |

-continued

| Polymer Blends (the parenthesized ratio is by weight): | | |
|---|---|---|
| PBB-1: | PEN/PET (60/40) | Tg = 95° C. |
| PBB-2: | PEN/PET (80/20) | Tg = 104° C. |
| PBB-3: | PAr/PEN (50/50) | Tg = 142° C. |
| PBB-4: | PAr/PCT (50/50) | Tg = 118° C. |
| PBB-5: | PAr/PET (60/40) | Tg = 101° C. |
| PBB-6: | PEN/PET/PAr (50/25/25) | Tg = 108° C. |

The polymer film of the present invention may contain an ultraviolet absorbent for the purpose of anti-fluorescence and of stabilization during storage, by kneading the absorbent into the film. As the ultraviolet absorbent, preferred are those which do not absorb visible rays. The amount of the absorbent in the polymer film is generally approximately from 0.5% by weight to 20% by weight, preferably approximately from 1% by weight to 10% by weight. If it is less than 0.5% by weight, the ultraviolet-absorbing effect of the film would be insufficient. Preferred examples of the ultraviolet absorbent include benzophenone compounds such as 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone, and 2,2'-dihydroxy-4,4'-dimethoxybenzophenone; benzotriazole compounds such as 2-(2'-hydroxy-5-methylphenyl)benzotriazole, 2-(2'-hydroxy-3',5'-di-t-butylphenyl)benzotriazole, and 2-(2'-hydroxy-3'-di-t-butyl-5'-methylphenyl)benzotriazole; and salicylic acid compounds such as phenyl salicylate and methyl salicylate.

Where the polymer film of the present invention is used as a support of a photographic material, it is extremely difficult to firmly stick photographic materials (such as light-sensitive silver halide emulsion layer, interlayer, filter layer, etc.) each having a protective colloid consisting essentially of gelatin on the support, since the polymer film has hydrophobic surfaces. The conventional technology for overcoming this problem includes, for example, the following two means:

(1) a method of previously activating the surface of the film to be coated with photographic layers by chemical treatment, mechanical treatment, corona-discharging treatment, flame treatment, ultraviolet ray treatment, high frequency treatment, glow-discharging treatment, active plasma treatment, laser treatment, mixed acid treatment, ozone oxidation treatment or the like, followed by direct coating of the thus activated surface with a photographic emulsion, whereby the adhesion between the surface of the support and the coated layer is elevated; and (2) a method of forming a subbing layer after the above-mentioned surface treatment or without the treatment, followed by coating a photographic emulsion layer over the subbing layer (for instance, refer to U.S. Pat. Nos. 2,698,241, 2,764,520, 2,864,755, 3,462,335, 3,475,193, 3,143,421, 3,501,301, 3,460,944, 3,674,531, British Patents 788,365, 804,005, 891,469, and JP-B-48-43122, JP-B-51-446).

The surface treatment of the support is believed to create more or less polar groups on its surface which has been originally hydrophobic or to increase the crosslinking density of its surface. As a result of the surface treatment, it is also believed that the affinity of the film for the polar groups of the components contained in the subbing layer increases or the fastness of the adhesive surface of the film increases. Various modifications of the constitution of the subbing layer have been made. For instance, a first layer which adheres well to the support (hereinafter referred to as a first subbing layer) is provided and a second hydrophilic resin layer which adheres well to a photographic layer (hereinafter referred to as a second subbing layer) is then coated over the first layer by a so-called multi-layer lamination method. Alternatively, only one resin layer having both hydrophobic and hydrophilic groups is coated on the support by a single layer coating method.

Of the surface treatments of method (1), corona-discharging treatment is the most popular method. It may be effected by any known means such as those disclosed in JP-B-48-5043, JP-B-47-51905, JP-A-47-28067, JP-A-49-83767, JP-A-51-41770, and JP-A-51-131576. The discharging frequency for the treatment may be from 50 Hz to 5000 kHz, preferably from 5 kHz to several hundred kHz. If the discharging frequency is too small, stable discharging could not be attained so that the treated surface unfavorably has pin holes. If, however, it is too large, the treatment unfavorably needs a particularly expensive device for impedance matching. The strength of the treatment is suitably from 0.001 KV.A.min/$m^2$ to 5 KV.A.min/$m^2$, preferably from 0.01 KV.A.min/$m^2$ to 1 KV.A.min/$m^2$, for improving the wettability of common plastic films such as polyester or polyolefin films. The gap clearance between the electrode and the dielectric roll may be from 0.5 to 2.5 mm, preferably from 1.0 to 2.0mm.

Glow-discharging treatment is the most effective surface treatment for many supports and it may be effected by any known means such as those described in JP-B-35-7578, JP-B-36-10336, JP-B-45-22004, JP-B-45-22005, JP-B-45-24040, JP-B-46-43480, U.S. Pat. Nos. 3,057,792, 3,057,795, 3,179,482, 3,288,638, 3,309,299, 3,434,735, 3,462,335, 3,475,307, 3,761,299, British Patent 997,093, and JP-A-53-129262.

Regarding the pressure condition for glow-discharging treatment, it may be generally from 0.005 to 20 Torr, preferably from 0.02 to 2 Torr. If the pressure is too low, the surface-treating effect by the treatment would lower. However, if it is too high, such a high pressure would yield a too large current flow to cause sparking dangerously and the treated support would be destroyed. The discharging is yielded by applying a high voltage to a pair or more of metal plates or metal rods as disposed with a distance therebetween in a vacuum tank. The voltage may be varied, depending upon the composition and pressure of the ambient vapor. In general, it may be between 500 V and 5000 V to yield stable constant glow discharging under the pressure of falling within the above-mentioned range. The especially preferred voltage range for improving the adhesiveness of the surface of he support is between 2000 V and 4000 V.

The discharging frequency may be from a direct current to several thousand MHZ, preferably from 50 Hz to 20 MHz, as is taught by the art. The discharging strength may be from 0.01 KV.A.min/$m^2$ to 5 KV.A.min/$m^2$, preferably from 0.15 KV.A.min/$m^2$ to 1 KV.A.min/$m^2$, to obtain the intended adhesiveness.

Subbing layer coating method (2) is explained below. For the first subbing layer to be formed in the multi-layer coating method, the characteristics of many polymers such as copolymers composed of, for example, monomers selected from vinyl chloride, vinylidene chloride, butadiene, methacrylic acid, acrylic acid, itaconic acid and maleic acid, as well as polyethyleneimine, epoxy resins, grafted gelatins, nitrocellulose and other polymers have been studied; and for the second subbing layer to be formed in the same, those of gelatin have been studied essentially.

In many cases of the single layer coating method, the support is first swollen and thereafter a hydrophilic polymer for the subbing layer is applied to the swollen support for interfacial mixing, whereby the adhesiveness of the support is elevated.

Examples of the polymer for the subbing layer employable in the present invention include water-soluble polymers, cellulose esters, latex polymers and water-soluble polyesters. Suitable water-soluble polymers include, for example, gelatin, gelatin derivatives, casein, agar, sodium alginate, starch, polyvinyl alcohol, polyacrylic acid copolymers, maleic anhydride copolymers and others. Suitable cellulose esters include, for example, carboxymethyl cellulose, hydroxyethyl cellulose and others. Suitable latex polymers include, for example, vinyl chloride-containing copolymers, vinylidene chloride-containing copolymers, acrylate-containing copolymers, vinyl acetate-containing copolymers, butadiene-containing copolymers and others. Of them, gelatin is the most preferred.

The compounds to be used for swelling the support in the present invention include, for example, resorcinol, chlororesorcinol, methylresorcinol, o-cresol, m-cresol, p-cresol, phenol, o-chlorophenol, p-chlorophenol, dichlorophenol, trichlorophenol, monochloroacetic acid, dichloroacetic acid, trifluoroacetic acid, chloral hydrate and others. Of them, preferred are resorcinol and p-chlorophenol.

The subbing layer of the present invention may contain various gelatin hardening agents. Suitable gelatin hardening agents include, for example, chromium salts (e.g., chromium alum), aldehydes (e.g., formaldehyde, glutaraldehyde), isocyanates, active halogen compounds (e.g., 2,4-dichloro-6-hydroxy-s-triazine), epichlorohydrin resins and others.

The subbing layer of the present invention may contain fine inorganic grains such as $SiO_2$, $TiO_2$ or matting agent or fine grains (having a grain size of from 1 to 10 μm) of polymethyl methacrylate copolymers.

In addition to them, other various additives may be added to the subbing layer, if desired. For instance, the layer may contain a surfactant, an antistatic agent, an anti-halation agent, a coloring dye, a pigment, a coating aid, an antifoggant and others. Where a first subbing layer is formed on the support of the present invention, it is quite unnecessary to incorporate an etching agent such as resorcinol, chloral hydrate or chlorophenol into the coating liquid. If desired, however, such an etching agent may of course be incorporated into the subbing layer coating liquid with no problem.

The subbing layer coating liquid may be coated on the support by any well-known method, for example, by dip-coating, air knife-coating, curtain-coating, roller-coating, wire bar-coating, gravure-coating, or by the extrusion coating method of using a hopper as described in U.S. Pat. No. 2,681,294. If desired, two or more layers may be coated simultaneously by the methods described in U.S. Pat. Nos. 2,761,791, 3,508,947, 2,941,898 and 3,526,528 and in Y. Harada, *Coating Engineering*, page 253 (published by Asakura Shoten K. K., 1973).

The binder of the backing layer optionally coated on the support of the present invention may be either a hydrophobic polymer or a hydrophilic polymer such as that in the subbing layer.

The backing layer may contain an antistatic agent, a lubricant agent, a mat agent, a surfactant, a dye and others. The antistatic agent in the backing layer is not specifically limited. For instance, it includes anionic polyelectrolytes of polymers containing carboxylic acids, carboxylic acid salts or sulfonic acid salts, such as those described in JP-A-48-22017, JP-B-46-24159, JP-A-51-30725, JP-A-51-129216 and JP-A-55-95942; and cationic polymers, such as those described in JP-A-49-121523, JP-A-48-91165 and JP-B-49-24582. The ionic surfactant in the layer may be either anionic or cationic. For instance, the compounds described in JP-A-49-85826, JP-A-49-33630, U.S. Pat. Nos. 2,992,108, 3,206,312, JP-A-48-87826, JP-B-49-11567, JP-B-49-11568 and JP-A-55-70837 are suitable.

The most preferred antistatic agent in the backing layer of the present invention is fine grains of at least one crystalline metal oxide selected from ZnO, $TiO_3$, $SnO_2$, $Al_2O_3$, $In_2O_3$, $SiO_2$, MgO, BaO and $MoO_3$ or a metal composite of them.

The fine grains of the conductive crystalline oxide or composite oxide used in the present invention have a volume resistivity of $10^7$ Ωcm or less, more preferably $10^5$ Ωcm or less. The grain size thereof is desirably from 0.002 to 0.7 μm, especially preferably from 0,005 to 0.3 μm.

The photographic material of the present invention is described below.

The photographic material according to the present invention comprises a silver halide emulsion layer, a backing layer, a protective layer, an interlayer, an antihalation layer, etc. These layers may be mainly used in the form of a hydrophilic colloidal layer.

The most commonly used in the hydrophilic colloidal layer are gelatin and gelatin derivatives. The term "gelatin" as used herein means so-called lime-treated gelatin, acid-treated gelatin or enzyme-treated gelatin.

In the present invention, an anionic, nonionic, cationic or betainic fluorine-containing surface active agent may be used in combination with other additives.

These fluorine-containing surface active agents are disclosed in, e.g., JP-A-49-10722, U.K. Patent 1,330,356, JP-A-53-84712, JP-A-54-14224, JP-A-50-113221, U.S. Pat. Nos. 4,335,201, 4,347,308, U.K. Patent 1,417,915, JP-B-52-26687, JP-B-57-26719, JP-B-59-38573, JP-A-55-149938, JP-A-54-48520, JP-A-54-14224, JP-A-58-200235, JP-A-57-146248, JP-A-58-196544, and U.K. Patent 1,439,402.

In the present invention, a nonionic surface active agent such as polyoxyethylene type may be further used.

The layer in which the fluorine-containing surface active agent and the nonionic surface active agent are incorporated is not specifically limited so far as it is at least one layer constituting the photographic material. For example, it may be a surface protective layer, an emulsion layer, an interlayer, a subbing layer, a backing layer or the like.

The amount of the fluorine-containing surface active agent and the nonionic surface active agent used in the present invention may be from 0.0001 g to 1 g, preferably from 0.0005 g to 0.5 g, more preferably from 0.0005 to 0.2 g, per $m^2$ of the photographic material. Two or more of these surface active agents may be used in admixture.

Further, a polyol compound as disclosed in, e.g., JP-A-54-89626 such as ethylene glycol, propylene glycol and 1,1,1-trimethyl propane may be incorporated in the protective laye or other layers.

The photographic material of the present invention may comprise a polymer latex as disclosed in, e.g., U.S. Pat. Nos. 3,411,911 and 3,411,912 and JP-B-45-5331 incorporated in the photographic constituent layers.

In the photographic material of the present invention, the silver halide emulsion layer and other hydrophilic colloidal layers may be hardened by various organic or inorganic hardeners (singly or in combination).

Typical examples of the silver halide color photographic material to which the present invention can be preferably applied include color reversal film and color negative film. In particular, general purpose color negative films are preferred.

The present invention will be further described with reference to general purpose color negative films.

The photographic material may have at least one silver halide emulsion layer of a blue-sensitive layer, a green-sensitive layer and a red-sensitive layer. The number of silver halide emulsion layers and non-light-sensitive emulsion layers and their sequence are not specifically limited. One typical example is a silver halide photographic material having at least one light-sensitive layer composed of a plurality of silver halide emulsion layers each having substantially the same color sensitivity but having a different sensitivity degree. The light-sensitive layer is a light-sensitive layer unit sensitive to any of blue light, green light and red light. In the case of a multi-layer silver halide color photographic material, in general, the sequence of the unit light-sensitive layers is such that a red-sensitive layer, a green-sensitive layer and a blue-sensitive layer are formed on the support in this order. However, the sequence may be reversed or modified or a different color-sensitive layer may be sandwiched between two of the same color-sensitive layers, in accordance with the object of the photographic material.

Non-light-sensitive layers such as an interlayer may be provided between the silver halide light-sensitive layers or as an uppermost layer or a lowermost layer.

The interlayer may contain couplers, DIR compounds and the like, such as those described in JP-A-61-43748, JP-A-59-113438, JP-A-59-113440, JP-A-61-20037 and JP-A-61-20038, and it may also contain an ordinary color mixing preventing agent.

The plurality of silver halide emulsion layers constituting the individual unit light-sensitive layer are described in, for example, German Patent 1,121,470, British Patent 923,045, JP-A-57-113751, JP-A-62-200350, JP-A-62-206541, JP-A-62-206543, JP-A-56-25738, JP-A-62-63936, JP-A-59-202464, JP-B-55-34932 and JP-B-49-15495.

Silver halide grains constituting the emulsion layer may be regular crystalline grains such as cubic, octahedral or tetradecahedral grains or irregular crystal-line grains such as spherical or tabular grains. They may also be grains having crystal defects such as a twin plane. They may also have a composite form.

Regarding the grain size of the silver halide grains, they may be fine grains having a grain size of about 0.2 microns or less or large grains having a grain size of up to about 10 microns as the diameter of the projected area. The emulsion may be either a poly-dispersed emulsion or a monodispersed emulsion.

The silver halide photographic emulsion to be used in the present invention may be prepared, for example, by the methods described in *Research Disclosure* (RD) No. 7643 (December, 1978), pp. 22–23, "I. Emulsion Preparation and Types".

The monodispersed emulsions described in U.S. Pat. Nos. 3,574,628, 3,655,394 and British Patent 1,413,748 are also preferably employed in the present invention.

Tabular silver halide grains having an aspect ratio of about 5 or more may also be employed in the present invention. Such tabular grains may be easily prepared, for example, by the methods described in Gutoff, *Phototographic Science and Engineering*, Vol. 14, pp. 248–257 (1970); and U.S. Pat. Nos. 4,434,226, 4,414,310, 4,438,048 and 4,439,520 and British Patent 2,112,157.

Regarding the crystal structure of the silver halide grains constituting the emulsions of the invention, the grains may have the same halogen composition throughout the whole grain, or they may have different halogen compositions between the inside part and the outside part of one grain, or they may have a layered structure. Further, the grains may have different halogen compositions conjugated by epitaxial junction, or they may have components other than silver halides, such as silver rhodanide or lead oxide, conjugated with the silver halide matrix. Additionally, a mixture of various grains of different crystal-line forms may be employed in the present invention.

The silver halide emulsions for use in the invention are generally physically ripened, chemically ripened and/or color-sensitized. The effect of the present invention is especially noticeable, when emulsions are sensitized with gold compounds and sulfur-containing compounds. Additives to be used in such a ripening or sensitizing step are described in *Research Disclosure* Nos. 17643 and 18716, and the related descriptions in these references are shown in the table mentioned below.

Various other known photographic additives which may be used in preparing the photographic materials of the present invention are mentioned in the above-mentioned two Research Disclosures, and the related descriptions therein are shown in the following table.

| Kinds of Additives | RD 17643 | RD 18716 |
|---|---|---|
| 1. Chemical Sensitizer | page 23 | page 648, right column |
| 2. Sensitivity Enhancer | | page 648, right column |
| 3. Color Sensitizing Agent<br>Super Color Sensitizing Agent | pages 23 to 24 | page 648, right column, to page 649, right column |
| 4. Brightening Agent | page 24 | |
| 5. Anti-foggant Stabilizer | pages 24 to 25 | page 649, right column |
| 6. Light Absorbent Filter Dye<br>Ultraviolet Absorbent | pages 25 to 26 | page 649, right column to page 650, left column |
| 7. Stain Inhibitor | page 25, right column | page 650, left column to right column |
| 8. Color Image Stabilizer | page 25 | |
| 9. Hardening Agent | page 26 | page 651, left column |
| 10. Binder | page 26 | page 651, left column |
| 11. Plasticizer, Lubricant | page 27 | page 650, right column |
| 12. Coating Aid | pages 26 to 27 | page 650, right column |
| Surfactant | pages 26 to 27 | page 650, right column |

In order to prevent deterioration of the photographic property of the photographic material of the invention by formaldehyde gas imparted thereto, compounds capable of reacting with formaldehyde so as to solidify it, for example, those described in U.S. Pat. Nos. 4,411,987 and 4,435,503, are preferably incorporated into the material.

Various color couplers can be incorporated into the photographic material of the present invention, and suitable examples of color couplers are described in patent publications referred to in the above-mentioned RD No. 17643, VII-C to G.

The above-mentioned couplers can be incorporated into the photographic materials of the present invention by various known dispersion methods.

Examples of high boiling point solvents used in an oil-in-water dispersion method are disclosed in U.S. Pat. No. 2,332,027. Examples of suitable high boiling point solvents having a boiling point of 175° C. or higher at normal pressure include phthalates, phosphates, phosphonates, benzoates, amides, alcohols, phenols, aliphatic carboxylates, aniline derivatives and hydrocarbons. Examples of auxiliary solvents which are also usable in the method include organic solvents having a boiling point of approximately from 30° C. to 160° C., preferably approximately from 50° C. to 160° C. Specific examples are ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes suitable for the method for impregnation are described in U.S. Pat. No. 4,199,363, German Patent (OLS) Nos. 2,541,274 and 2,541,230.

It is desired that the total film thickness of all the hydrophilic colloid layers having emulsion layers provided on the surface of the support is 28 microns or less in the photographic material of the present invention. It is also desired that the photographic material of the invention has a film swelling rate (T1/2) of 30 seconds or less. The film thickness referred to herein means one measured under the controlled conditions of a temperature of 25° C. and a relative humidity of 55% (for 2 days); and the film swelling T1/2 rate referred to herein may be measured by any means known in this technical field.

The present invention is explained in more detail by way of the following examples, which, however, are not intended to restrict the scope of the present invention. All parts are by weight unless otherwise indicated.

EXAMPLES

The curling degree measuring method and the related terminologies referred to hereinafter are defined below.

(1) Core setting:

This is to wind a film around a spool for curling it.

(2) Core set curl:

This means the lengthwise direction curl of a film made by core setting. The curling degree is measured by test method A of ANSI/ASC PH1.29–1985 and is represented as 1/R (m) (where R indicates the radius of the curl).

(3) Absolute core set curl:

This indicates the core set curl of a photographic film to which no improvement in reducing the curl has been applied.

(4) Controlled core set curl:

This indicates the core set curl of a photographic film to which an improvement in reducing the curl has been applied.

(5) True core set curl:

This is represented by (absolute core set curl)–(controlled core set curl).

(6) Degree of reduction of curl:

This is represented by [(true core set curl)/(absolute core set curl)]×100

(7) Glass transition temperature (Tg):

Using a differential scanning colorimeter (DSC), 10 mg of a sample film is heated in a helium/nitrogen stream at a rate of 20° C/min, a mathematical average temperature of the temperature at which the heated film begins to be shifted from its base line and the temperature at which it comes back to a new base line is obtained.

EXAMPLE 1

(1) Preparation of Supports:

One hundred parts by weight of a commercially available polyethylene-2,6-naphthalate polymer was melted with 2 parts of a commercially available ultraviolet absorbent, Tinuvin P. 326 (produced by Ciba-Geigy), after having been dried by an ordinary method at 300° C. and then extruded through a T-die. The film was lengthwise stretched 3.3 times at 140° C. and then widthwise stretched 3.3 times at 130° C. This was then fixed at 250° C. for 6 seconds to obtain a film of 90 μm thick (PEN Film).

A commercially available polyethylene terephthalate polymer was biaxially stretched and fixed by an ordinary method to obtain a film of 90 μm thick (PET Film).

In preparing PEN film, Compounds (I-24), (I-6) and (I-15) were added thereto in an amount of 2/3/2 (by weight), then the final increased amount of the transmission density was adjusted to be 0.03 at a wavelength of from 400 nm to 700 nm. Film A was thus prepared. Film B was prepared in the same manner as Film A, except that the inventive dyes were not added.

Film C was prepared in the same manner as Film A, except for using a PET film in place of the PEN film. Film D was prepared in the same manner as Film C, except that the inventive dyes were not added.

Film E was prepared in the same manner as Film A, except for using poly(oxyisophthanoyloxy-2,6-dimethyl-1,4-phenyleneisopropylidene-3,5-dimethyl-1,4-phenylene) (referred to as "compound A") in place of the PEN film. Film F was prepared in the same manner as Film E, except that the inventive dyes were not added.

(2) Heat Treatment of Supports:

With respect to Films A to F, Films A and B were heat-treated at 110° C., Films C and D at 70° C., and Films E and F at 195° C., for 24 hours. For the heat treatment, each film was wound around a core reel having a diameter of 30 cm with the subbing layer-coated surface being outside. In addition, non-heat-treated Films A to E were evaluated. Non-heat-treated Films A to F were designated as A1, B1, C1, D1, E1 and F1, respectively. Heat-treated Films A to F were designated as A2, B2, C2, D2, E2 and F2, respectively.

The transmission density of each film was determined by X-RITE STATUS M of X-RITE Co. through blue, green, and red filters, respectively.

(3) Coating of Subbing Layer:

Both surfaces of Films A1 to F1 and Films A2 to F2 were treated by glow-discharging under reduced pressure of 0.2 Torr at output power of 2500 W and processing strength of 0.5 KV.A.min/m$^2$. After 10 ml/m$^2$ of a subbing layer having the following composition was coated, the resulting film was dried at 115° C. for 3 min. (At this time, it was confirmed that the internal temperature of the casing in the carrying system and the temperature of the carrying roller were substantially 115° C.)

| Composition of Subbing Layer A: | |
|---|---|
| Gelatin | 1.0 part |
| Salicylic Acid | 0.3 part |
| Formaldehyde | 0.05 part |
| p-$C_9H_{19}C_6H_4O(CH_2CH_2O)_{10}H$ | 0.1 part |
| Distilled Water | 2.2 parts |
| Methanol | 96.35 parts |

(4) Coating of Backing Layer:

After the subbing layer was coated on one surface of each of the supports, a backing layer having the composition mentioned below was coated on the other surface.

(4-1) Preparation of Dispersion of Fine Conductive Grains (dispersion of tin oxide-antimony oxide composite):

Two hundred thirty parts by weight of stannic chloride hydrate and 23 parts by weight of antimony trichloride were dissolved in 3000 parts by weight of ethanol to obtain a uniform solution. One N aqueous sodium hydroxide solution was dropwise added to the uniform solution until the latter had a pH of 3, whereby co-precipitates of colloidal stannic oxide and antimony oxide were formed. The co-precipitates thus formed were allowed to stand as they were at 50° C. for 24 hours to obtain reddish brown colloidal precipitates.

The reddish brown colloidal precipitates were separated by centrifugation. In order to remove the excess ions, water was added to the co-precipitates for washing them by centrifugation. The operation was repeated three times whereby the excess ions were removed from the co-precipitates.

Two hundred parts by weight of the colloidal precipitates from which the excess ions had been removed were again dispersed in 1500 parts by weight of water, and the resulting dispersion was sprayed into a firing furnace of 600° C. to obtain a bluish powder of fine grains of tin oxide-antimony oxide composite having a mean grain size of 0.2 μm. The specific resistivity of the fine powdery grains was 25 Ω.cm.

A mixed liquid comprising 40 parts by weight of the fine powdery grains and 60 parts by weight of water was adjusted to have a pH of 7.0 and roughly dispersed with a stirrer. This was then further dispersed in a horizontal sand mill (Dyno Mill, trade name by WILLYA BACHOFENAG) until the residence time was 30 minutes.

(4-2) Formation of Backing Layer:

The following composition (A) was coated on the support and dried at 115° C. for 60 seconds to have a dry thickness of 1 μm. In addition, the following Coating Liquid (B) was coated over the layer and dried at 115° C. for 3 minutes to have a dry thickness of 1 μm.

| Composition (A): | |
|---|---|
| Dispersion of Conductive Fine Grains (prepared above) | 10 parts |
| Gelatin | 1 part |
| Water | 27 parts |
| Methanol | 60 parts |
| Resorcinol | 2 parts |
| Polyoxyethylene Nonylphenyl Ether | 0.01 part |
| **Coating Liquid (B):** | |
| Cellulose Triacetate | 1 part |
| Acetone | 70 parts |
| Methanol | 15 parts |
| Dichloromethylene | 10 parts |
| p-Chlorophenol | 4 parts |
| Silica Grains (Average Grain Size 0.2 μm) | 0.01 part |
| Polysiloxane | 0.005 part |

-continued

| | |
|---|---|
| Dispersion of $C_{15}H_{31}COO_{40}H_{81}$/ $C_{50}H_{101}O(CH_2CH_2O)_{16}H$ (8/2 by weight) (Average Grain Size 20 nm) | 0.01 part |

(5) Coating of Photographic Layers:

A plurality of layers each having the composition mentioned below were coated on the opposite side of the backing layer coated side (i.e., the subbing layer side). The resulting photographic material showed satisfactory photographic properties.

Compositions of Photographic Layers:

Essential components constituting the photographic layers are grouped as follows:

ExC: Cyan Coupler

UV : Ultraviolet Absorbent

ExM: Magenta Coupler

HBS: High Boiling Point Organic Solvent

ExY: Yellow Coupler

H : Gelatin Hardening Agent

ExS: Sensitizing Dye

The number for each component indicates the coated amount by way of g/m$^2$. The amount of silver halide coated is represented as the amount of silver coated therein. The amount of sensitizing dye coated is represented by way of a molar unit to mol of silver halide in the same layer.

| (Sample 101) | |
|---|---|
| **First Layer: Anti-halation Layer** | |
| Black Colloidal Silver | 0.18 as Ag |
| Gelatin | 1.40 |
| ExM-1 | 0.18 |
| ExF-1 | $2.0 \times 10^{-3}$ |
| HBS-1 | 0.20 |
| **Second Layer: Interlayer** | |
| Emulsion G | 0.065 as Ag |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| **Third Layer: Low-sensitivity Red-sensitive Emulsion Layer** | |
| Emulsion A | 0.25 as Ag |
| Emulsion B | 0.25 as Ag |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.010 |
| ExC-5 | 0.020 |
| ExC-7 | 0.0050 |
| ExC-8 | 0.010 |
| Cpd-2 | 0.025 |
| HBS-1 | 0.10 |
| Gelatin | 0.87 |
| **Fourth Layer: Middle-sensitivity Red-sensitive Emulsion Layer** | |
| Emulsion D | 0.70 as Ag |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |

(Sample 101)

| | |
|---|---|
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| Fifth Layer: High-sensitivity Red-sensitive Emulsion Layer | |
| Emulsion E | 1.40 as Ag |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |
| Gelatin | 1.20 |
| Sixth Layer: Interlayer | |
| Cpd-1 | 0.10 |
| HBS-1 | 0.50 |
| Gelatin | 1.10 |
| Seventh Layer: Low-sensitivity Green-sensitive Emulsion Layer | |
| Emulsion C | 0.35 as Ag |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Eighth Layer: Middle-sensitivity Green-sensitive Emulsion Layer | |
| Emulsion D | 0.80 as Ag |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| Ninth Layer: High-sensitivity Green-sensitive Emulsion Layer | |
| Emulsion E | 1.25 as Ag |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| Tenth Layer: Yellow Filter Layer | |
| Yellow Colloidal Silver | 0.030 as Ag |
| Cpd-1 | 0.16 |
| HBS-1 | 0.60 |
| Gelatin | 0.60 |
| Eleventh Layer: Low-sensitivity Blue-sensitive Emulsion Layer | |
| Emulsion C | 0.18 as Ag |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.10 |
| Twelfth Layer: Middle-sensitivity Blue-sensitive Emulsion Layer | |
| Emulsion D | 0.40 as Ag |
| ExS-7 | $7.4 \times 10^{-4}$ |
| ExC-3 | $7.0 \times 10^{-3}$ |
| ExY-2 | 0.050 |
| ExY-3 | 0.10 |
| HBS-1 | 0.050 |
| Gelatin | 0.78 |
| Thirteenth Layer: High-sensitivity Blue-sensitive Emulsion Layer | |
| Emulsion F | 1.00 as Ag |
| ExS-7 | $4.0 \times 10^{-4}$ |
| ExY-2 | 0.10 |
| ExY-3 | 0.10 |
| HBS-1 | 0.070 |
| Gelatin | 0.86 |
| Fourteenth Layer: First Protective Layer | |
| Emulsion G | 0.20 as Ag |
| UV-4 | 0.11 |
| UV-5 | 0.17 |
| HBS-1 | $5.0 \times 10^{-2}$ |
| Gelatin | 1.00 |
| Fifteenth Layer: Second Protective Layer | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition, the respective layers contained any of W-1 through W-3, B-4 through B-7, F-1 through F-17, and iron salt, lead salt, gold salt, platinum salt, iridium salt and rhodium salt, so as to have improved storability, processability, pressure resistance, fungicidal and bactericidal properties, antistatic property and coatability.

TABLE 1

| | Mean AgI Content (%) | Mean Grain Size (μm) | Fluctuation Coefficient to Grain Size (%) | Ratio of Diameter/ Thickness | Ratio of Silver Contents [core/ interlayer/shell] (as AgI content %) | Structure and Shape of Grains |
|---|---|---|---|---|---|---|
| Emulsion A | 4.0 | 0.45 | 27 | 1 | [1/3] (13/1) | two-layer structural octahedral grains |
| Emulsion B | 8.9 | 0.70 | 14 | 1 | [3/7] (25/2) | two-layer structural |

TABLE 1-continued

| | Mean AgI Content (%) | Mean Grain Size (μm) | Fluctuation Coefficient to Grain Size (%) | Ratio of Diameter/ Thickness | Ratio of Silver Contents [core/ interlayer/shell] (as AgI content %) | Structure and Shape of Grains |
|---|---|---|---|---|---|---|
| Emulsion C | 2.0 | 0.55 | 25 | 7 | — | octahedral grains uniform structural tabular grains |
| Emulsion D | 9.0 | 0.65 | 25 | 6 | [12/59/29] (0/11/8) | three-layer structural tabular grains |
| Emulsion E | 9.0 | 0.85 | 23 | 5 | [8/59/33] (0/11/8) | three-layer structural tabular grains |
| Emulsion F | 14.5 | 1.25 | 25 | 3 | [37/63] (34/3) | two-layer structural tabular grains |
| Emulsion G | 1.0 | 0.07 | 15 | 1 | — | uniform structural fine grains |

In Table 1 above;

(1) Emulsions A to F had been subjected to reduction sensitization with thiourea dioxide and thiophosphonic acid during formation of the grains, in accordance with the example of JP-A-2-191938;

(2) Emulsions A to F had been subjected to gold sensitization, sulfur sensitization and selenium sensitization in the presence of the color sensitizing dyes in the respective light-sensitive layers and sodium thiocyanate, in accordance with the example of JP-A-3-237450;

(3) for preparation of tabular grains, a low molecular gelatin was used in accordance with the example of JP-A-1-158426; and (4) tabular grains and normal crystal-line grains having a granular structure were observed to have dislocation lines as described in JP-A-3-237450, with a high-pressure electronic microscope.

ExC-1

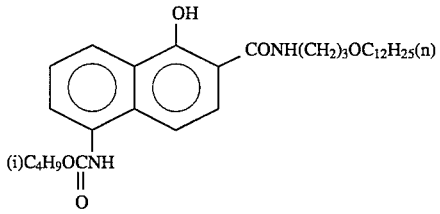

ExC-2

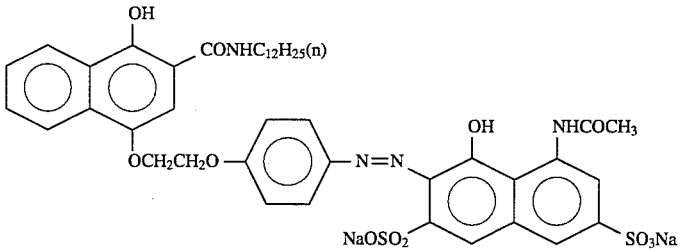

ExC-3

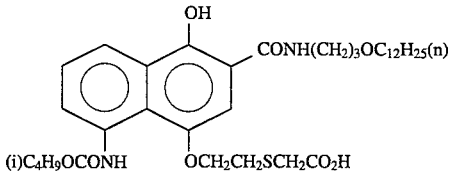

ExC-4

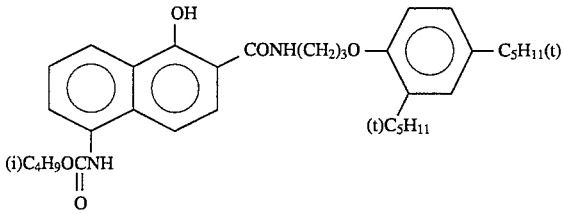

-continued
ExC-5
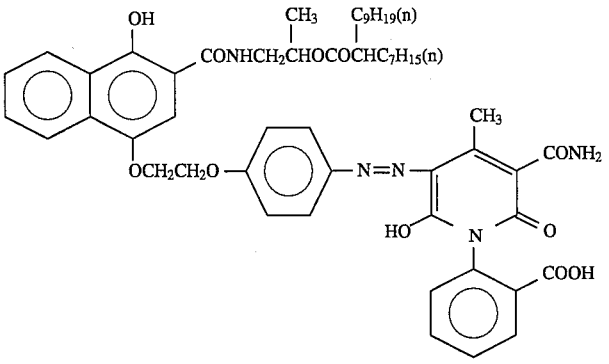
ExC-6
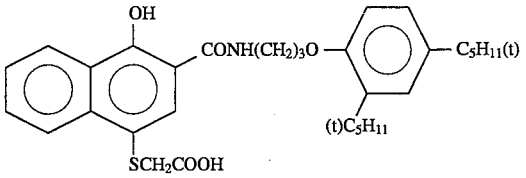
ExC-7
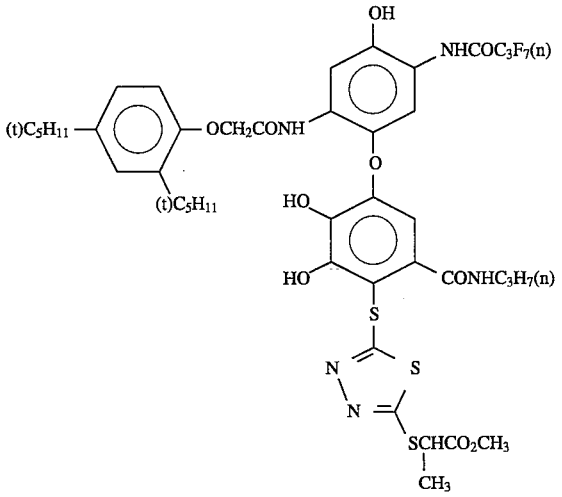
ExC-8
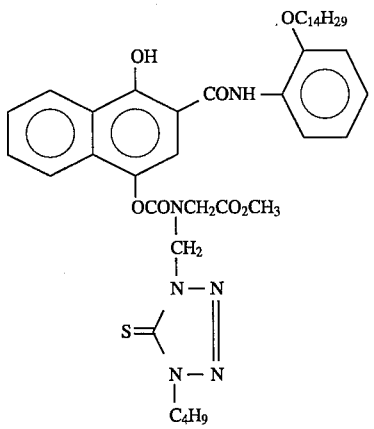

-continued
ExM-1
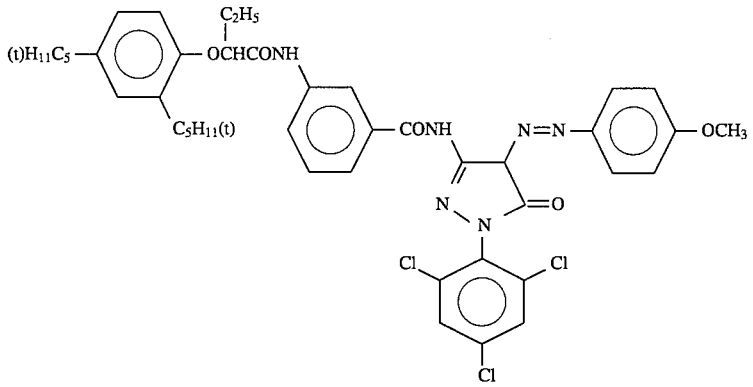
ExM-2
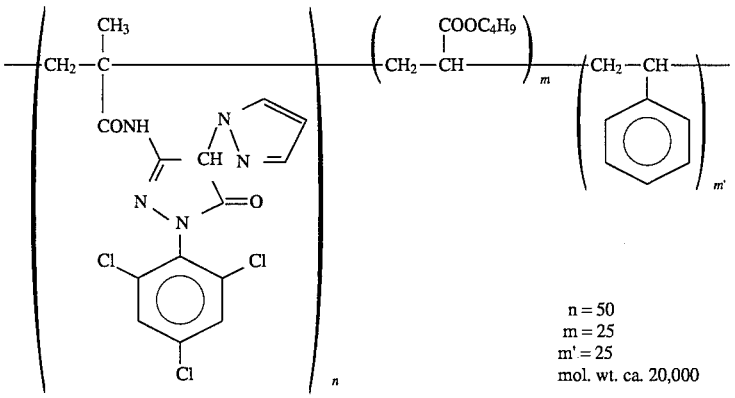
n = 50
m = 25
m' = 25
mol. wt. ca. 20,000
ExM-3
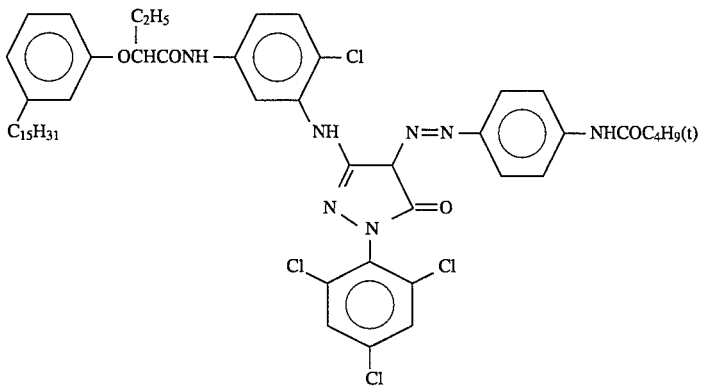
ExM-4
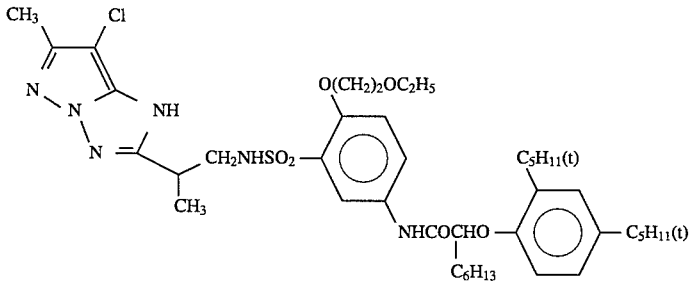

-continued
ExM-5
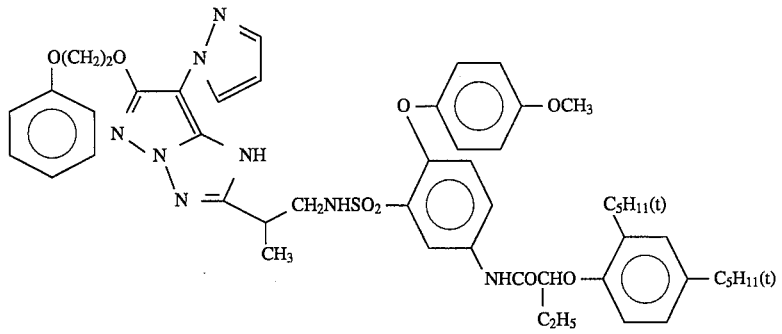
ExY-1
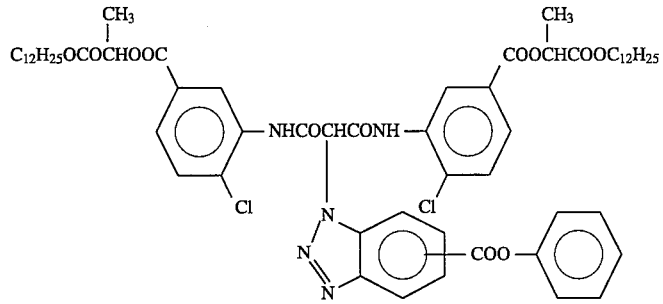
ExY-2
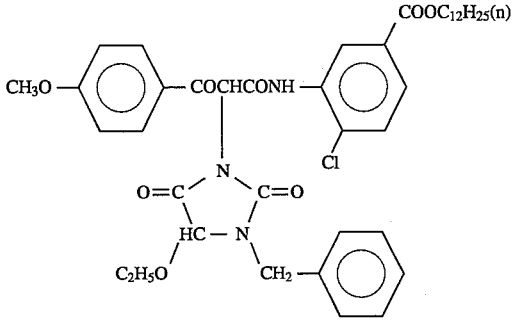
ExY-3
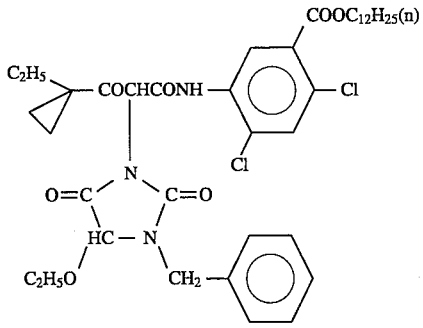
ExY-4
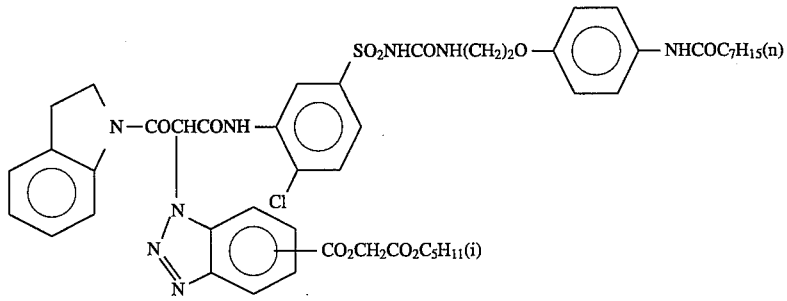

-continued
ExF-1
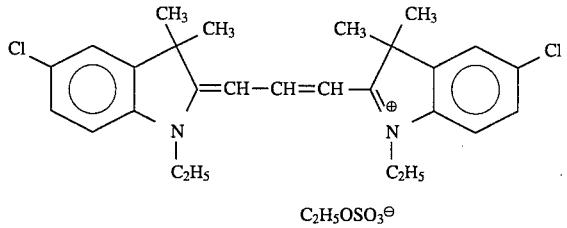
Cpd-1
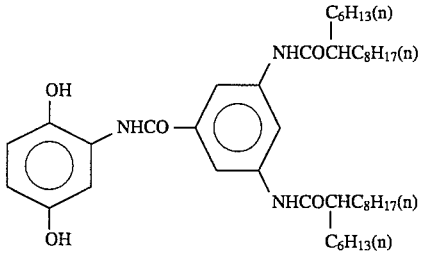
Cpd-2
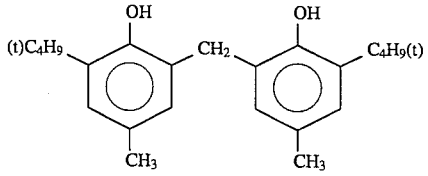
Cpd-3
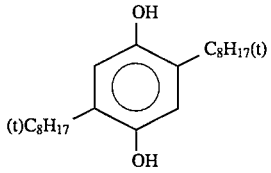
UV-1
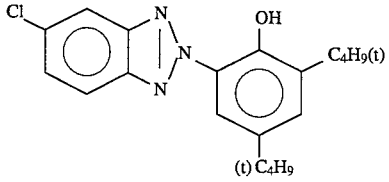
UV-2
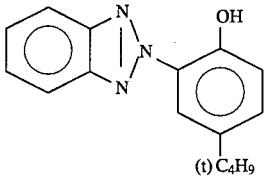
UV-3
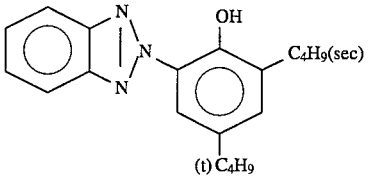
UV-4
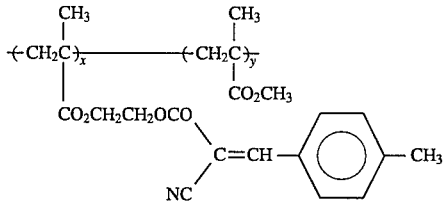
x:y = 70:30 (wt %)

-continued
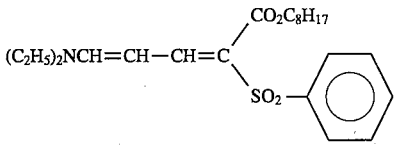
(UV-5)
Tricresyl Phosphate HBS-1
Di-n-butyl Phthalate HBS-2
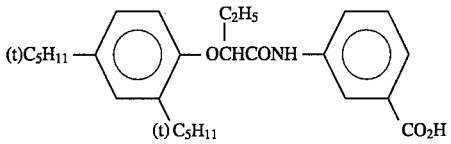
HBS-3
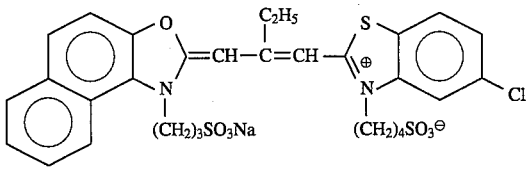
ExS-1
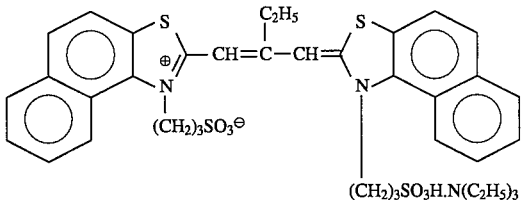
ExS-2
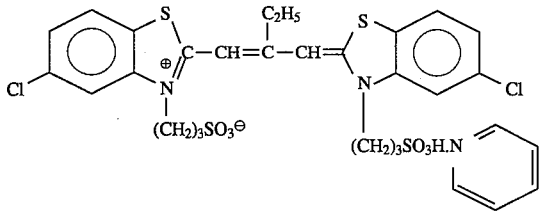
ExS-3
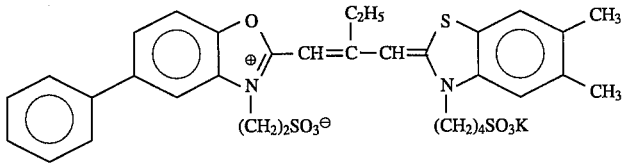
ExS-4
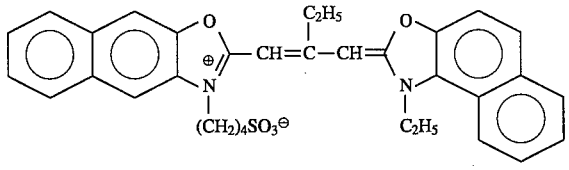
ExS-5
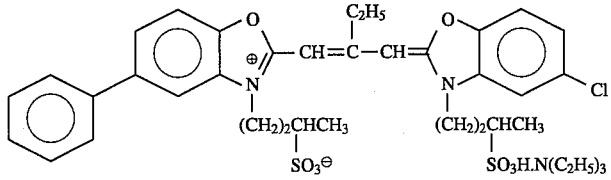
ExS-6

-continued
ExS-7
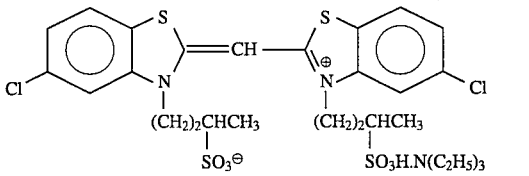
S-1
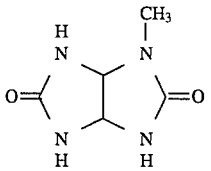
H-1
$CH_2{=}CH{-}SO_2{-}CH_2{-}CONH{-}CH_2$
$CH_2{=}CH{-}SO_2{-}CH_2{-}CONH{-}CH_2$
B-1
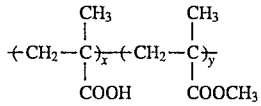
x/y = 10/90
B-2
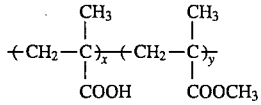
x/y = 40/60
B-3
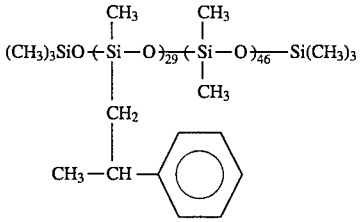
B-4
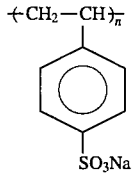
B-5
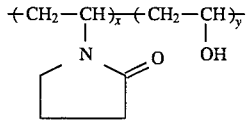
x/y = 70/30
B-6
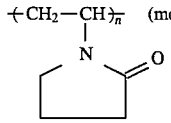
(mol. wt. about 10,000)
W-1
$C_8F_{17}SO_2NHCH_2CH_2CH_2OCH_2CH_2\overset{\oplus}{N}(CH_3)_3$
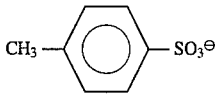
W-2
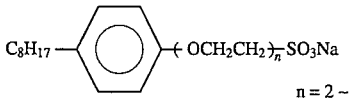
n = 2 ~ 4

-continued
W-3
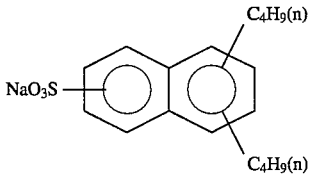
F-1
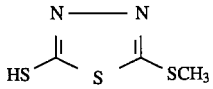
F-2
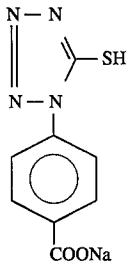
F-3
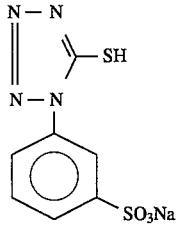
F-4
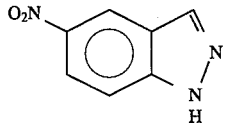
F-5
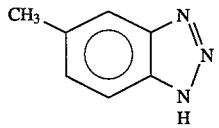
F-6
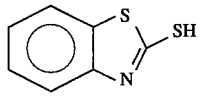
F-7
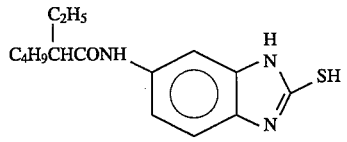
F-8
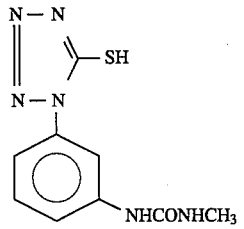
F-9
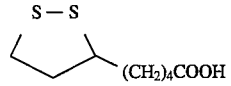

-continued

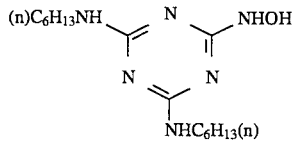

F-10

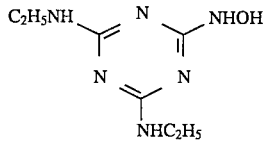

F-11

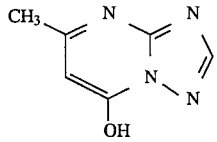

F-12

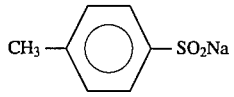

F-13

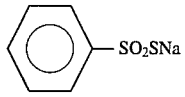

F-14

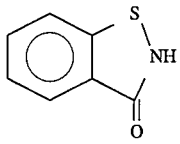

F-15

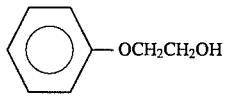

F-16

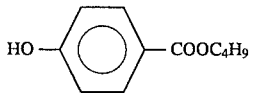

F-17

(6) Evaluation of Samples:

Films A1 to F2 and A2 to F2 thus prepared were tested with respect to their curl and light-piping in accordance with the process mentioned below.

(6-1) Measurement of Curl:

Each sample film having a width of 35 mm was slit to have a length of 1.8 m. The both ends thereof were perforated in accordance with the method as described in JP-A-1-271197. Each sample was conditioned overnight at 25° C. and 60% RH and wound around a spool having a diameter of 7 mm, with the photographic layers being inside. The roll film sample was put in a sealed container and heated at 80° C. for 2 hours for curling it. The temperature condition corresponded to the condition in which film is put in a car in a summer season.

The film samples as curled under the above-mentioned condition were cooled overnight in a room at 25° C. and then taken out from the sealed containers. These were developed with an automatic developing machine (Minilab. FP-550B Model; manufactured by Fuji Photo Film Co., Ltd.) and then immediately the degree of the curl of each sample was measured at 25° C. under 60% RH with a curl-measuring plate.

Development of the samples was effected in accordance with the process described below.

Color Development Process:

| Step | Temperature | Time |
|---|---|---|
| Color Development | 38° C. | 3 min |
| Stopping | 38° C. | 1 min |
| Rinsing | 38° C. | 1 min |
| Bleaching | 38° C. | 2 min |
| Rinsing | 38° C. | 1 min |
| Fixing | 38° C. | 2 min |
| Rinsing | 38° C. | 1 min |
| Stabilization | 38° C. | 1 min |

The compositions of the processing solutions used above are mentioned below.

Color Developer:

| | |
|---|---|
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Disodium Ethylenediaminetetraacetate | 2 g |

-continued

| | |
|---|---|
| Dihydrate | |
| 4-Amino-3-methyl-N-ethyl-N-(β-hydroxy-ethyl)aniline Monosulfate | 4 g |
| Water to make | 1 liter |
| Stopping Solution: | |
| Sodium Thiosulfate | 10 g |
| Ammonium Thiosulfate (70% aqueous solution) | 30 ml |
| Acetic Acid | 30 ml |
| Sodium Acetate | 5 g |
| Potassium Alum | 15 g |
| Water to make | 1 liter |
| Bleaching Solution: | |
| Sodium Ethylenediaminetetraacetate/ Iron (III) Dihydrate | 100 g |
| Potassium Bromide | 50 g |
| Ammonium Nitrate | 50 g |
| Boric Acid | 5 g |
| Aqueous Ammonia to make | pH of 5.0 |
| Water to make | 1 liter |
| Fixing Solution: | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 liter |
| Stabilizing Bath: | |
| Boric Acid | 5 g |
| Sodium Citrate | 5 g |
| Sodium Metaborate Tetrahydrate | 3 g |
| Potassium Alum | 15 g |
| Water to make | 1 liter |

The measurement of curl was determined in accordance with TEST METHOD A of ANSI/ASC PH1.29-1985, which is represented by 1/R (m) (R: curl radius), in which the higher value means layer curling. A value of not higher than 65 has practically no problem.

(6-2) Light-Piping:

Each sample film was cut to 35 mm in width and 1.8 m in length, and put in a usual light-shielded patrone equipped with tufted fabric. With 50 mm of the top being led, after the sample was allowed to stand for 5 min. under fluorescent light of about 1000 lux, development was effected in accordance with the process described above. The length of fogging in the light-shielded portion of each sample is set forth in Table 2. Two mm or lower of the fogging length shows substantially no light-piping. The longer fogging length shows that light-piping tends to occur easier.

From the results shown in Table 2, it can be seen that the inventive samples provide substantially no problem in curling and no light-piping.

EXAMPLE 2

The same test was conducted in the same manner as in Example 1, except for using Compounds (I-12) and (II-4) in an amount ratio of 1/1 (by weight). The final amounts added were the same as in Example 1. The results obtained were similar to those in Example 1.

EXAMPLE 3

The same test was conducted in the same manner as in Example 1, except that 0.01 wt % of titanium dioxide or carbon black or barium sulfate was incorporated into each support polymer instead of the dyes used. The results obtained were similar to those in Example 1.

EXAMPLE 4

The same test was conducted in the same manner as in Example 1, except for using the polymer shown in Table 3 in place of PEN film. G2 to I2 were a polymer blend type and J2 to L2 were a copolymer type. The heat treatment temperature and the treatment time are shown in Table 4. The resulting properties are similar to those obtained using the PEN film in Example 1.

TABLE 2

| No. | Support | Grass Transition Temperature (°C.) | Dye | Heat Treatment (24 hr.) (°C.) | Curling (after development) | Light-Piping | Notes |
|---|---|---|---|---|---|---|---|
| A1 | PEN | 119 | ○ | — | 125 | 2 mm or lower | Comparison |
| A2 | " | " | ○ | 110 | 44 | 2 mm or lower | Invention |
| B1 | " | " | — | — | 126 | 37 mm | Comparison |
| B2 | " | " | — | 110 | 45 | 36 mm | Comparison |
| C1 | PET | 69 | ○ | — | 211 | 2 mm or lower | Comparison |
| C2 | " | " | ○ | 60 | 202 | 2 mm or lower | Comparison |
| D1 | " | " | — | — | 213 | 2 mm or lower | Comparison |
| D2 | " | " | — | 60 | 201 | 2 mm or lower | Comparison |
| E1 | Compound A | 205 | ○ | — | 201 | 2 mm or lower | Comparison |
| E2 | " | " | ○ | 195 | 112 | 2 mm or lower | Comparison |
| F1 | " | " | — | — | 208 | 2 mm or lower | Comparison |
| F2 | " | " | — | 195 | 120 | 2 mm or lower | Comparison |

TABLE 3

| | Blend Polymer (by weight ratio) | | | | Copolymer (by mol ratio) | | | | |
|---|---|---|---|---|---|---|---|---|---|
| No. | PEN | PET | PAr | PCT | NDCA | TPA | EG | CHDM | BPA |
| G2 | 80 | 20 | — | — | — | — | — | — | — |
| H2 | 60 | 40 | — | — | — | — | — | — | — |
| I2 | — | — | 50 | 50 | — | — | — | — | — |
| J2 | — | — | — | — | 75 | 25 | 100 | — | — |
| K2 | — | — | — | — | 50 | 50 | 100 | — | — |
| L2 | — | — | — | — | — | 100 | 25 | 25 | 50 |
| M2 | — | — | 100 | — | — | — | — | — | — |

TABLE 4

| | Glass Transition | Heat Treatment | | | | |
|---|---|---|---|---|---|---|
| No. | Temperature (°C.) | Temp. (°C.) | Time (h) | Curling (after development) | Light-Piping | Notes |
| G2 | 104 | 94 | 6 | 51 | 2 mm or lower | Invention |
| H2 | 95 | 85 | 6 | 56 | 2 mm or lower | Invention |
| I2 | 118 | 108 | 6 | 47 | 2 mm or lower | Invention |
| J2 | 102 | 92 | 8 | 50 | 2 mm or lower | Invention |
| K2 | 92 | 82 | 7 | 59 | 2 mm or lower | Invention |
| L2 | 112 | 102 | 6 | 49 | 2 mm or lower | Invention |
| M2 | 192 | 178 | 10 | 47 | 2 mm or lower | Invention |

EXAMPLE 5

The same test was conducted in the same manner as in Example 1, except for using a combination of the dyes shown in Table 5 instead of the combination of the dyes used in Example 1. The results obtained were similar to those in Example 1.

TABLE 5

| | Kind of Dye Used | | | | Increase of Base Density By Dye Addition | | |
|---|---|---|---|---|---|---|---|
| | | | | | Blue Filter | Green Filter | Red Filter |
| No. | I-1 | I-6 | I-24 | I-25 | Density | Density | Density |
| O | — | 65 | 65 | — | 0.02 | 0.02 | 0.03 |
| P | — | 65 | 130 | — | 0.02 | 0.03 | 0.05 |
| Q | — | 130 | — | 260 | 0.04 | 0.06 | 0.10 |
| R | 260 | 80 | — | — | 0.01 | 0.05 | 0.07 |
| S | 520 | 160 | — | — | 0.02 | 0.10 | 0.14 |
| T | 180 | 85 | 50 | — | 0.02 | 0.05 | 0.09 |

As described above, the present invention enables to provide a silver halide photographic material which is hard to curl and free from light fogging due to light-piping.

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having thereon at least one silver halide emulsion layer, wherein the support is polyester having a glass transition temperature of from 90° C. to 200° C. and contains at least one of a dye represented by the following formula (I) or (II):

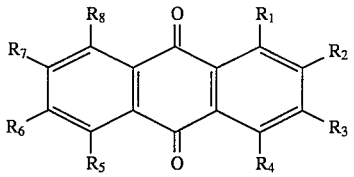

(I)

wherein $R_1$, $R_2$, $R_3$, $R_4$, $R_5$, $R_6$, $R_7$ and $R_8$ are the same or different and each represents a hydrogen atom, a hydroxyl group, an aliphatic group, an aromatic group, a heterocyclic group, a halogen atom, a cyano group, a nitro group, $—COR_9$, $—COOR_9$, $—NR_9R_{10}$, $—NR_{10}COR_{11}$, $—NR_{10}SO_2R_{11}$, $—CONR_9R_{10}$, $—CONHSO_2R_{11}$ or $—SO_2NHCOR_{11}$, in which $R_9$ and $R_{10}$ each represents a hydrogen atom, an aliphatic group, an aromatic group or a heterocyclic group, $R_{11}$ represents an aliphatic group, an aromatic group or a heterocyclic group, and $R_9$ and $R_{10}$ may be combined with each other to form a 5- or 6- membered ring; and $R_1$ and $R_2$, or $R_2$ and $R_3$ may be combined with each other to form a ring;

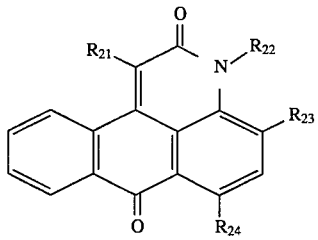

(II)

wherein $R_{21}$, $R_{23}$ and $R_{24}$ are the same or different and each represents a hydrogen atom, a hydroxyl group, a nitro group, a cyano group, an aliphatic group, —$COR_{29}$, —$COOR_{29}$, —$NR_{29}R_{30}$, —$NR_{30}COR_{31}$ or —$NR_{30}SO2R_{31}$, in which $R_{29}$ and $R_{30}$ each has the same meanings as defined for R9 and $R_{10}$ respectively in formula (I), and $R_{31}$ has the same meaning as defined for $R_{11}$ in formula (I);

$R_{22}$ represents an aliphatic group or an aromatic group; and at least one or $R_{21}$, $R_{22}$, $R_{23}$ and $R_{24}$ is a group other than a hydrogen atom; and wherein said support has an increased amount of transmission density through a blue, green and red filter, respectively, of 0.01–0.3 at a wavelength of 400–700 nm;

said dye represented by formula (I) or (II) is present in a total amount of 0.001–1.0 g/m$^2$;

said support is heat-treated at a temperature of from 50° C. to its glass transition temperature after forming a film and before coating a light-sensitive layer; and said film is resistant to curling.

2. The silver halide photographic material as claimed in claim 1, wherein the polyester comprises naphthalene dicarboxylic acid and ethylene glycol.

3. The silver halide photographic material as claimed in claim 2, wherein the polyester is polyethylene-2,6-naphthalene dicarboxylate.

4. A silver halide photographic material as claimed in claim 1, wherein the dyes represented by formula (I) or (II) are used in combination.

5. A silver halide photographic material as claimed in claim 1, wherein the increased amount of transmission density is 0.01–0.1.

6. A silver halide photographic material as claimed in claim 1, wherein the dye represented by formula (I) or (II) is present in an amount of 0.005–0.5 g/m$^2$.

* * * * *